United States Patent [19]

Matta

[11] Patent Number: 4,938,175

[45] Date of Patent: Jul. 3, 1990

[54] ENGINE, PARTICULARLY FOR ULTRALIGHT AIRCRAFT

[75] Inventor: Luigi Matta, Arignano, Italy

[73] Assignee: Offmar S.n.c. di Matta Emiliano & Matta Luigi, Turin, Italy

[21] Appl. No.: 270,591

[22] Filed: Nov. 14, 1988

[30] Foreign Application Priority Data

Nov. 12, 1987 [IT] Italy ..... 67963 A/87

[51] Int. Cl.[5] ..... F02B 61/00

[52] U.S. Cl. ..... 123/52 A; 123/197 R; 60/718; 74/661

[58] Field of Search ..... 123/52 A, 53 AA, 53 BA, 123/DIG. 1, DIG. 8, 197 R; 74/661, 665 B, 665 E; 60/698, 716, 718

[56] References Cited

U.S. PATENT DOCUMENTS 3,351,045 11/1967 Knuth ..... 123/53 BA 4,367,703 1/1983 Maucher et al. ..... 123/52 A 4,394,854 7/1983 Huber ..... 123/52 A 4,638,637 1/1987 Kronogard et al. ..... 123/52 A

FOREIGN PATENT DOCUMENTS 3034976 4/1982 Fed. Rep. of Germany ... 123/52 A 2140870 12/1984 United Kingdom ..... 123/52 A

*Primary Examiner*—David A. Okonsky

*Attorney, Agent, or Firm*—Sughrue, Mion, Zinn, Macpeak & Seas

[57] ABSTRACT

An engine, particularly for ultralight aircraft, comprises an engine block carrying at least one pair of autonomous drive units with respective driving shafts connected independently to a common output shaft by means of respective one-way transmission units arranged to couple the output shaft and the driving shafts for rotation only when the respective drive units are in the operating condition.

5 Claims, 1 Drawing Sheet

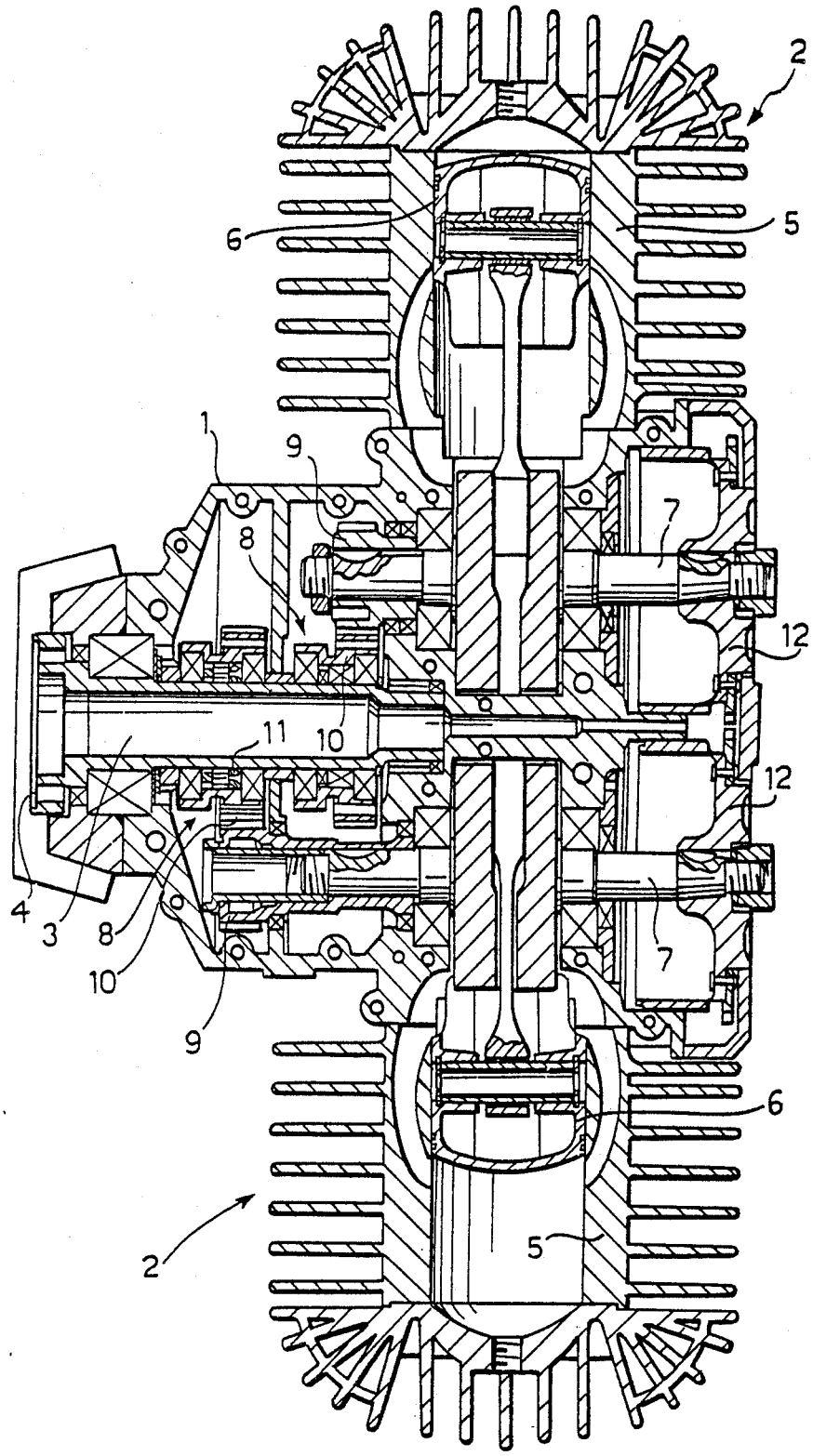
2
6
5
1
9
8
7
12
11
10
12
4
3
8
10
7
9
6
2
5

ENGINE, PARTICULARLY FOR ULTRALIGHT AIRCRAFT

The present invention relates to an engine for aeronautical applications, particularly for ultralight aircraft.

The object of the invention is to produce a simple and compact engine which is formed in such a way that it ensures considerably greater safety in operation than conventional engines currently used for these applications.

The engine according to the invention is characterised in that it comprises an engine block carrying at least one pair of autonomous drive units with respective driving shafts connected independently to a common output shaft by means of respective one-way transmission units arranged to couple the output shaft and the driving shafts for rotation only when the respective drive units are in the operating condition.

In practice, the engine according to the invention is composed of separate drive units all or some of which can be activated to drive a propeller fitted to the output shaft. This enables the maximum power delivered by the engine to be proportioned in dependence on the requirements of use, whilst ensuring a high degree of safety in that damage to one of the drive units in no way affects the operation of the other or others.

Each transmission unit preferably includes a reduction unit with driving and driven gears of which the first is keyed to the respective driving shaft and the second is mounted on the output shaft with the interposition of a free wheel.

Preferably, but not necessarily, the drive units comprise cylinder-piston internal combustion units.

If it is intended for an ultralight aircraft, the engine according to the invention conveniently has two opposed cylinder-piston units. However, alternative radial or in-line configurations are possible, even with a different number of cylinder-piston units.

Again in the case of application to ultralight aircraft, the cylinder-piston units of the engine conveniently have a two-stroke cycle.

The invention will now be described in detail with reference to the appended drawing, provided purely by way of non-limiting example, which shows in longitudinal section a two-cylinder engine according to the invention for ultralight aircraft.

With reference to the drawing, the engine includes an engine block 1 carrying two internal-combustion drive units 2 arranged in an opposed configuration relative to an output shaft 3 which is supported centrally by the engine block 1 and carries an external flange 4 for the fitting of a propeller.

Each drive unit 2 is constituted by an air-cooled cylinder 5 - piston 6 unit with a two-stroke cycle.

The two cylinder-piston units 2 are provided with respective crankshafts 7 supported for rotation by the engine block 1 on opposite sides of the output shaft 3 and connected thereto by means of respective one-way transmission units 8. Each of the transmission units 8 comprises a reduction unit constituted by a driving gear 9 which is keyed to the crankshaft 7 and a driven gear 10 which is mounted on the output shaft 3 with the interposition of a free wheel 11. Each free wheel 11 acts to couple the output shaft 3 for rotation with the crankshaft 7 of the respective drive unit 2 only when the latter is in the operating condition.

As explained above, the two drive units 2 are completely autonomous and independent of each other so that they can be activated and de-activated selectively, together or separately. For this purpose, a gear 12 is fitted to each crankshaft 7 at its end opposite the respective one-way transmission 8 and is adapted to engage a pinion, not illustrated, which is operated by an autonomous electric starting motor.

In this way, the output shaft 3, and hence the propeller fitted thereto, can be driven by the two drive units 2 simultaneously or by only one of them. In the second case, the drive unit 2 which is kept de-activated remains completely disconnected from the output shaft 3, by virtue of the respective free wheel 11.

As well as a greater flexibility of use derived from the capacity to double or halve the maximum power delivered, the engine according to the invention ensures considerably greater safety in operation than is the case with conventional engines currently used for ultralight aircraft. In fact, when both the drive units 2 are in the operating condition, any damage to one of them does not interfere in any way with the operation of the other, whilst, when the engine is used with only one of the two drive units operating, the other drive unit can be activated immediately to replace the first in the event of damage.

Although the example illustrated relates specifically to a two-cylinder engine with opposed drive units 2, the invention can be applied to engines with different arrangements (radial or in-line) and with different numbers of drive units, even if they are not internal combustion engines.

I claim:

1. An engine, particularly for ultralight aircraft, comprising an engine block (1) carrying at least one pair of autonomous drive units (2) with respective driving shafts (7) connected independently to a common output shaft (3) by means of respective one-way transmission units (8) arranged to automatically couple the output shaft (3) and the driving shafts (7) for rotation only when the respective drive units (2) are in the operating condition.

2. An engine according to claim 1, wherein each transmission unit (8) includes a reducer unit with driving and driven gears (9, 10) of which the first (9) is keyed to the respective driving shaft (7) and the second (10) is mounted on the output shaft (3) with the interposition of a free wheel (11).

3. An engine according to claim 1, wherein the drive units are constituted by cylinder-piston internal combustion units (2).

4. An engine according to claim 3, wherein it has two opposed cylinder-piston units (2).

5. An engine according to claim 3, wherein the cylinder-piston units (2) have a two-stroke cycle.

* * * * *